US007259527B2

(12) United States Patent
Foo

(10) Patent No.: US 7,259,527 B2
(45) Date of Patent: Aug. 21, 2007

(54) STEPPED DIMMING BALLAST FOR FLUORESCENT LAMPS

(75) Inventor: Onn Fah Foo, Kowloon (HK)

(73) Assignee: Mass Technology (H.K.) Limited, Kowloon (HK)

( * ) Notice: Subject to any disclaimer, the term of this patent is extended or adjusted under 35 U.S.C. 154(b) by 0 days.

(21) Appl. No.: 11/435,841

(22) Filed: May 18, 2006

(65) Prior Publication Data

US 2006/0261753 A1 Nov. 23, 2006

(30) Foreign Application Priority Data

May 20, 2005 (CN) ..... 2005 1 0072474

(51) Int. Cl.
*G05F 1/00* (2006.01)

(52) U.S. Cl. ..... 315/291; 315/307; 315/194; 315/209 R; 315/DIG. 4

(58) Field of Classification Search ..... 315/291, 315/209 R, 224, 194, 362, 244, DIG. 4, DIG. 7; 323/237, 300, 319, 320
See application file for complete search history.

(56) References Cited

U.S. PATENT DOCUMENTS

| | | | | |
|---|---|---|---|---|
| 5,471,119 | A * | 11/1995 | Ranganath et al. | 315/307 |
| 5,754,036 | A * | 5/1998 | Walker | 323/237 |
| 5,872,429 | A * | 2/1999 | Xia et al. | 315/194 |
| 6,486,616 | B1 * | 11/2002 | Liu et al. | 315/291 |
| 2005/0134196 | A1 * | 6/2005 | Cook et al. | 315/291 |

* cited by examiner

*Primary Examiner*—Haissa Philogene
(74) *Attorney, Agent, or Firm*—Rabin & Berdo, P.C.

(57) ABSTRACT

A stepped dimming ballast comprising a filter and rectifier circuit (1), a DC high voltage stabilizing circuit (2), a frequency control and switch circuit (3), a load current feedback circuit (5), a voltage signal processing circuit (6) and a voltage signal sampling circuit (7). The present invention is adapted for use in conjunction with a silicon controlled rectifier dimmer and/or a regular light switch whereby it is novel in structure and able to effect dimming in two predetermined and reliable operation modes.

20 Claims, 2 Drawing Sheets

Partial of Fig. 1 to accompany the Abstract
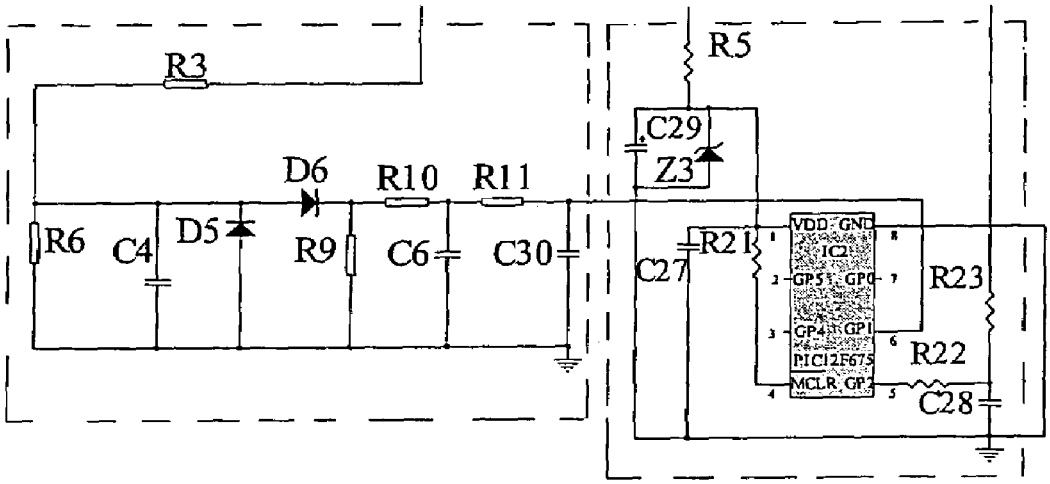

STEPPED DIMMING BALLAST FOR FLUORESCENT LAMPS

TECHNICAL FIELD

The present invention relates to a dimmable ballast for fluorescent lamps, and more particularly to a stepped dimming ballast for fluorescent lamps adapted for use in conjunction with a silicon controlled rectifier dimmer and/or a regular light switch.

BACKGROUND OF THE INVENTION

A dimmable fluorescent lamp is needed for a long time. Unlike an incandescence lamp in which a common silicon controlled rectifier (SCR) is employed to effect dimming, a fluorescent lamp is a nonlinear load and exhibits a negative resistance characteristic such that the dimming cannot be correspondingly effected in the same manner. In the available domestic and commercial dimmers a TRIAC is usually employed, and a characteristic of which is the requirement of a holding current for maintaining the on state thereof after it has been triggered. The characteristic suits the operation modes of a resistive load such as an incandescence lamp so well but being undesired by a capacitive load such as a fluorescent lamp for the reason that blinking might occur and a proper working state thereof might not be maintained in course of dimming while such dimmers are employed, which in turns has an adverse effect on the life span of the fluorescent lamp.

There is a need for dimmers in a variety of places under various circumstances in daily life, whereby a number of SCR dimmers have already been installed in different places. It is thus desirable for a dimmable fluorescent lamp adapted for such dimmers and it is also preferable to effect dimming by means of a regular light switch in those places without such dimmers.

SUMMARY OF THE INVENTION

An object of the present invention is to eliminate the foregoing technical problems in the prior art by providing a stepped dimming ballast for fluorescent lamps, which is adapted for use in conjunction with a silicon controlled rectifier dimmer and/or a regular light switch thereby it is novel in structure and able to effect dimming in two predetermined and reliable operation modes.

According to an embodiment of the present invention, a stepped dimming ballast for fluorescent lamps is provided for realizing above object, which comprises:

- a filter and rectifier circuit;
- a frequency control and switch circuit for controlling frequency, generating switch driving signals and delivering an adjustable high voltage to a lamp load; and
- a voltage signal sampling circuit for converting a variation in the conduction angle of a SCR dimmer or the on/off states of a regular light switch into a voltage signal and delivering such signal to a voltage signal processing circuit by which a dimming control voltage is generated in accordance with a predetermined program while the voltage signal being identified as a valid alteration and sent to the frequency control and switch circuit, thereby controlling the alternation of a set of predetermined working states of which in a cyclic manner for effecting the multi-stepped dimming.

Preferably, the embodiment of the present invention further comprises a load current feedback circuit; and a DC high voltage stabilizing circuit by which the high frequency energy output by the frequency control and switch circuit can be fed back into an energy storage capacitor.

According to the embodiment of the present invention, the voltage signal processing circuit is provided with a threshold voltage by which a valid alteration of the voltage signal provided from the voltage signal sampling circuit can be identified each time the voltage of such signal exceeds the threshold voltage.

Preferably, the threshold voltage provided with the voltage signal processing circuit ranges from 1 V to 4.5 V.

Further, the leading edge of the voltage signal provided by the voltage signal sampling circuit can be used in determining whether the voltage of such signal exceeds the threshold voltage or being a valid alteration or trigger to effect dimming. Alternatively, the lagging edge of the voltage signal provided by the voltage signal sampling circuit can be also used in determining the same.

According to the embodiment, the number of predetermined working states ranges from 2 to 10, wherein the variation of the predetermined working states being repeated cyclic from the brightest state to one or more stepped dimming states, the dimmest state and then back to the brightest state.

Alternatively, the variation of the predetermined working states being repeated cyclic from the dimmest state to one or more stepped brightening states, the brightest state and then back to the dimmest state.

According to the present invention, the multi-stepped dimming can be effected in two predetermined and reliable operation modes. One of which is by virtue of the alteration of the conduction angle of the silicon controlled rectifier dimmer or by means of the momentary switching of the regular light switch thereof. A valid alteration will be identified while the conduction angle of the SCR dimmer being varied from the maximum to a suitable level and then back to the initial value. Alternatively, a valid alteration will be identified while the ballast is switched off and on within a short duration by making use of the light switch.

Preferably, the brightest state will be resumed automatically while the ballast is switched off and on again after a long duration despite of which working state the ballast is previously in.

According to the embodiment, a capacitor of the voltage signal processing circuit is provided for the discrimination of the short and long duration for which the ballast has been switched off and lasted in accordance with a predetermined critical duration. Preferably, the critical duration ranges from 0 to 10 seconds and the capacitance of the capacitor ranges from 22 μF to 220 μF.

BRIEF DESCRIPTION OF THE DRAWINGS

The present invention will be described in more detail based on the following description of a merely exemplary embodiment with reference to the accompanying drawings, in which.

DETAILED DESCRIPTION OF THE PREFERRED EMBODIMENTS

Figure 1:
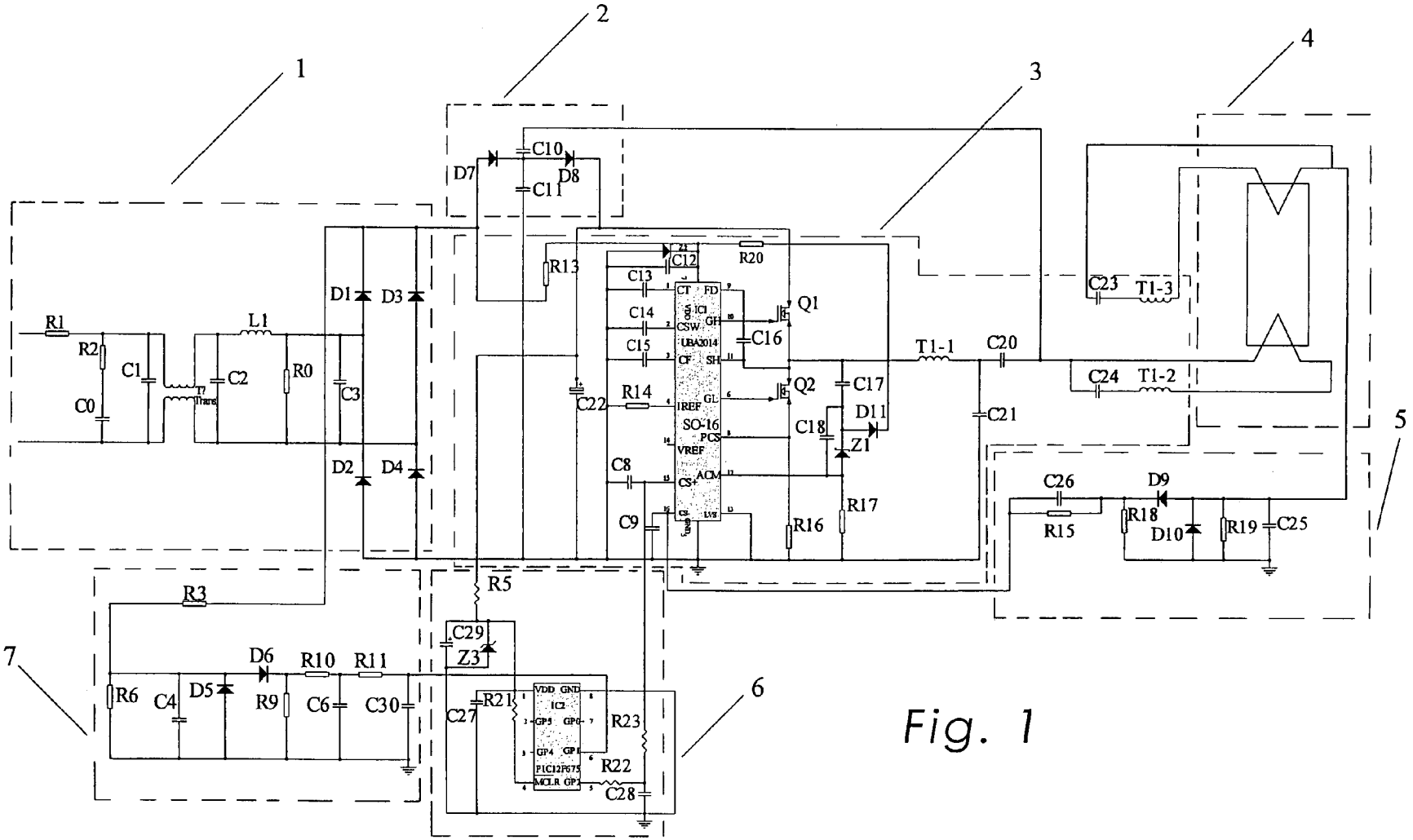
FIG. 1 is a circuit diagram of an embodiment in accordance with the present invention.

Referring to FIG. 1, a circuit diagram of a stepped dimming ballast for fluorescent lamps in accordance with the present invention is illustrated. The stepped dimming ballast comprises a filter and rectifier circuit 1, a DC high voltage stabilizing circuit 2, a frequency control and switch circuit 3, a load current feedback circuit 5, a voltage signal processing circuit 6 and a voltage signal sampling circuit 7. Wherein a lamp load 4 is coupled with the output end of the frequency control and switch circuit 3.

According to the embodiment, the filter and rectifier circuit 1 comprises, in series, a π filter, a LC filter, a RC filter and a bridge rectifier whereby to filter the high frequency interference waves from the coupled AC power source and converting the AC input voltage thereof into the DC ripple voltage.

The output end of the filter and rectifier circuit 1 couples with the input end of the DC high voltage stabilizing circuit 2 having its output end connected to the frequency control and switch circuit 3 for supplying a stable DC high voltage thereto. The feedback end of the DC high voltage stabilizing circuit 2 being connected to the output end of the frequency control and switch circuit 3 whereby feeding back the high frequency energy output thereof into a energy storage capacitor C22 of the DC high voltage stabilizing circuit 2.

As shown in the figure, the DC high voltage stabilizing circuit 2 further comprises two diodes D7, D8 in series connection and a capacitors C10 having its one end connected to a junction point in between the two diodes D7, D8 and the other end of which being connected to another junction point in between the lamp load 4 and the output end C20 of the frequency control and switch circuit 3 whereby the high frequency energy thereof can be fed through the capacitor C10 and back into the energy storage capacitor C22 after being first rectified by the diode D8.

The frequency control and switch circuit 3 comprises a dimmer integrated circuit chip IC1 for controlling the working frequency and generating high frequency switching signals, and its associated external components comprising two switch transistors Q1, Q2 and their respective resistors and capacitors connected therewith. The input end of the frequency control and switch circuit 3 being connected to the output end of the DC high voltage stabilizing circuit 2 whereby an adjustable high frequency voltage can be generated and pass through the oscillation circuit for ensuring a stable operation of the lamp load 4.

The load current feedback circuit 5 as shown in the embodiment comprises resistors (R15, R18, R19), capacitors (C25, C26) and diodes (D9, D10) connected in an adaptive manner.

The voltage signal sampling circuit 7 in the embodiment comprises resistors (R3, R6, R9, R10, R11), capacitors (C4, C6, C30) and diodes (D5, D6) whereby to converts a variation in the conduction angle of a SCR dimmer into a voltage signal and delivers such signal to the voltage signal processing circuit 6. The input end of which couples with the output end of the filter and rectifier circuit 1 while its output end being connected to a programmable IC chip IC2 of the voltage signal processing circuit 6. Wherein the input voltage is divided through the resistors R3, R6 and then charges up the capacitor C4. A required phase angle signal for dimming can be sampled at capacitor C30 after the divided voltage pass through and being processed respectively by each of the circuit components (D5, D6, R9, R10, C6), thereby delivering a voltage signal to the voltage signal processing circuit 6 for further processing.

The voltage signal processing circuit 6 comprises a programmable IC chip IC2 and its associated external components R5, R21, R22, R23, C27, C28, C29, Z3 connected in an adaptive manner, wherein the components R5, C29, Z3 act as the power source to the IC2. The input end of the voltage signal processing circuit 6 couples with the output end of the voltage signal sampling circuit 7 while its output end being connected to the control end of the IC1 in the frequency control and switch circuit 3. In the programmable IC2 a suitable program is provided, by which the voltage signal corresponding to the variation in conduction phase angle of a dimmer or on/off states caused by momentary switching of the light switch being sampled by the voltage signal sampling circuit 7 can be further processed for the delivering of a dimming control voltage to the control end of the IC1 whereby to effect a stepped dimming in a reliable manner.

The voltage signal sampling circuit 7 and the voltage signal processing circuit 6 as shown are the innovative circuits provided by present invention. A DC ripple voltage sampled by the voltage signal sampling circuit 7 being further processed by making use of the direct proportional relationship between the effective value of the ripple voltage and the conduction phase angle of a SCR dimmer, such that the voltage of the signal resulting from the variation in the conduction angle of the SCR dimmer can exceed a threshold voltage provided with the voltage signal processing circuit 6 thereby acting as a valid trigger to effect dimming. Alternatively, while a regular light switch is used to effect dimming, the signal voltage delivered by the voltage signal sampling circuit 7 drops from the maximum to the minimum value when the switch being turned off and then it rises from the minimum to the maximum value when the switch being turned on again within a short duration, thereby making the threshold voltage provided with the voltage signal processing circuit 6 to be exceeded by the signal voltage which can be identified as a valid trigger to effect dimming in the same manner.

Preferably, the threshold voltage provided with the voltage signal processing circuit 6 ranges from 1V to 4.5 V. Wherein both the leading edge and lagging edge of the voltage signal provided by the voltage signal sampling circuit 7 can be used in determining whether the voltage of such signal exceeds the threshold voltage or being a valid trigger to effect dimming.

According to the embodiment of the present invention, a valid alteration of the voltage signal will be identified as a trigger for dimming by the voltage signal processing circuit 6 each time the voltage of the signal exceeds the threshold voltage thereof. Accordingly, the voltage signal processing circuit 6 will then output a dimming control voltage to the control end of the IC1 in the frequency control and switch circuit 3 in accordance with a predetermined program whereby switching to one of the predetermined working states of which in a cyclic manner for effecting the multi-stepped dimming. Preferably, the number of predetermined working states ranges from 2 to 10 as required for practical use. Wherein the variation of the predetermined working states can be repeated cyclic from the brightest state to one or more multiple stepped dimming states, the dimmest state and then directly back to the brightest state. Alternatively, the variation of the predetermined working states can be also repeated cyclic from the dimmest state to one or more multiple stepped brightening states, the brightest state and then directly back to the dimmest state in a similar manner.

Preferably, the brightest state thereof have to be resumed automatically while the ballast according to the present invention is switched on again after switching off for a long duration, no matter which working state the ballast is previously in, such that the working states can be sequentially altered as required in accordance with the ambient brightness. Further, the DC high voltage stabilizing circuit 2 feeds back the high frequency energy thereof into the energy storage capacitor C22 for ensuring that the DC high voltage will not drop dramatically during the frequency modulation within a specific range thereby effect the dimming in a more reliable manner.

Similarly, the load current feedback circuit 5 feeds back the current from the lamp load 4 to the dimmer IC chip IC1 thereby further ensuring that the dimming can be effected in a more stable and reliable manner.

The voltage signal sampling circuit 7 and the voltage signal processing circuit 6 as shown are designed specifically for effecting the stepped dimming of the fluorescent lamps. These two circuits 6, 7 will work together as a whole and complementary to each other such that the multi-stepped dimming can be effected in two different modes by means of the program being appropriately programmed with some suitably adjusted parameters stored in the programmable IC2.

One of the two modes is operated by virtue of the variation in the conduction angle of a SCR dimmer by which a set of the predetermined working state can be varied in a cyclic manner each time a valid trigger is identified while the conduction angle of the SCR dimmer being adjusted from the maximum to a suitable level and then back to the initial value. In this connection, the variation of the predetermined working states will be subjected in accordance to the program by means of repeatedly alternating the conduction angle of the dimmer, wherein the maximum conduction angle should preferably be always resumed after each variation for ensuring the stable operation of the lamp load. Preferably, the brightest state must be resumed automatically while the ballast according to the present invention is switched off and on again after a long duration despite of the working state the ballast is previously in.

Alternatively, the other mode thereof is operated by virtue of the momentary switching of a regular light switch by which a set of the predetermined working state can also be varied in a cyclic manner each time a valid trigger is identified while the light switch being switched off and on again rapidly within a short duration. In this connection, the variation of the predetermined working states will be subjected in accordance to the program through repeatedly switching the light switch on and off in a momentary manner. Preferably, the brightest state must be resumed automatically while the ballast according to the present invention is switched on again after being switched off for a long duration despite of the working state the ballast is previously in.

According to the embodiment, the capacitor C29 of the voltage signal processing circuit 6 is provided for the discrimination of the short and long duration for which the ballast has been switched off and lasted with respect to a predetermined critical duration, which can ranges from 0 to 10 seconds. In general, the critical duration can be set at 5 seconds for practical use and the preferred range of which being from 1 to 3 seconds. Further, the capacitance of the capacitor C29 ranges from 22 μF to 220 μF, which can be adaptively adjusted depending on the value of the critical duration and parameters of each of external components in the voltage signal sampling circuit 6. Preferably, there should be an appreciable distinction among the critical duration, short duration and long duration to avoid the emergence of any faulty operation. For example, the long duration should be longer than 2 seconds and the short duration should be shorter than 1 second while the critical duration is set at 1.5 second in length.

The identification of the valid trigger caused by the variation in the conduction angle of the dimmer or the change of on/off states by the momentary switching of the light switch is conducted by the programmable integrated circuit IC2 whereby the stepped dimming ballast according to the present invention is simple in structure and reliable in operation such that it can be easily adapted for a fluorescent lamp, in particularly a compact type fluorescent lamp in which the ballast in question can be fully integrated.

It should be understood that the above embodiment is merely an exemplary but not limitative example while many other embodiments of the present invention are also possible, and many corresponding modifications as well as variations can be made by a person skilled in the art as according to the disclosure of the present invention and without departing from the spirits and essentials thereof. Such modifications and variations should fall within the scope of the following claims of the present invention.

What is claimed is:

1. A stepped dimming ballast for fluorescent lamps comprising:

a filter and rectifier circuit (1);

a frequency control and switch circuit (3) for controlling frequency, generating switch driving signals and delivering an adjustable high voltage to a lamp load; and a voltage signal sampling circuit (7) for converting a variation in the conduction angle of a SCR dimmer or the on/off states of a regular light switch into a voltage signal and delivering such signal to a voltage signal processing circuit (6) by which a dimming control voltage is generated in accordance with a predetermined program while the voltage signal being identified as a valid alteration and then sent to the frequency control and switch circuit (3), thereby controlling the alternation of a set of predetermined working states of which in a cyclic manner for effecting the multi-stepped dimming.

2. A stepped dimming ballast as claimed in claim 1, wherein it further comprises a load current feedback circuit (5); and a DC high voltage stabilizing circuit (2) by which the high frequency energy output by the frequency control and switch circuit (3) can be fed back into an energy storage capacitor (C22).

3. A stepped dimming ballast as claimed in claim 1, wherein the voltage signal sampling circuit (7) comprises resistors (R3, R6, R9, R10, R11), diodes (D5, D6) and capacitors (C4, C6, C30); wherein the voltage signal delivered to the voltage signal processing circuit (6) is provided by the capacitor (C30).

4. A stepped dimming ballast as claimed in claim 1, wherein the voltage signal processing circuit (6) is provided with a threshold voltage by which a valid alteration of the voltage signal provided from the voltage signal sampling circuit (7) can be identified each time the voltage of such signal exceeds the threshold voltage.

5. A stepped dimming ballast as claimed in claim 4, wherein the threshold voltage provided with the voltage signal processing circuit (6) ranges from 1 V to 4.5 V.

6. A stepped dimming ballast as claimed in claim 4, wherein the leading edge of the voltage signal provided by the voltage signal sampling circuit (7) can be used in determining whether the voltage of such signal exceeds the threshold voltage or being a valid trigger to effect dimming.

7. A stepped dimming ballast as claimed in claim 4, wherein the lagging edge of the voltage signal provided by the voltage signal sampling circuit (7) can be used in determining whether the voltage of such signal exceeds the threshold voltage or being a valid trigger to effect dimming.

8. A stepped dimming ballast as claimed in claim 4, wherein the number of predetermined working states ranges from 2 to 10.

9. A stepped dimming ballast as claimed in claim 4, wherein the variation of the predetermined working states being repeated cyclic from the brightest state to one or more stepped dimming states, to the dimmest state and then back to the brightest state.

10. A stepped dimming ballast as claimed in claim 4, wherein the variation of the predetermined working states being repeated cyclic from the dimmest state to one or more stepped brightening states, to the brightest state and then back to the dimmest state.

11. A stepped dimming ballast as claimed in claim 4, wherein the multi-stepped dimming is effected by virtue of the alteration of the conduction angle of the silicon controlled rectifier dimmer or the momentary switching of the light switch thereof.

12. A stepped dimming ballast as claimed in claim 11, wherein a valid alteration will be identified while the conduction angle of the silicon controlled rectifier dimmer being varied from the maximum to a suitable level and then back to the initial value.

13. A stepped dimming ballast as claimed in claim 11, wherein a valid alteration will be identified while the ballast is switched off and on within a short duration by means of the light switch.

14. A stepped dimming ballast as claimed in claim 11, wherein the brightest state will be resumed automatically while the ballast is switched on again after being switched off for a long duration despite of the working state the ballast is previously in.

15. A stepped dimming ballast as claimed in claim 13, wherein the capacitor (C29) of the voltage signal processing circuit (6) is provided for the discrimination of the short duration for which the ballast has been switched off and lasted in accordance with a predetermined critical duration.

16. A stepped dimming ballast as claimed in claim 14, wherein the capacitor (C29) of the voltage signal processing circuit (6) is provided for the discrimination of the long duration for which the ballast has been switched off and lasted in accordance with a predetermined critical duration.

17. A stepped dimming ballast as claimed in claim 15, wherein the critical duration ranges from 0 to 10 seconds.

18. A stepped dimming ballast as claimed in claim 16, wherein the critical duration ranges from 0 to 10 seconds.

19. A stepped dimming ballast as claimed in claim 15, wherein the capacitance of the capacitor (C29) ranges from 22 μF to 220 μF.

20. A stepped dimming ballast as claimed in claim 16, wherein the capacitance of the capacitor (C29) ranges from 22 μF to 220 μF.

* * * * *